US008973750B2

(12) United States Patent
Agirbas

(10) Patent No.: US 8,973,750 B2
(45) Date of Patent: Mar. 10, 2015

(54) CIGARETTE PACK COMPRISING A COVER THAT IS GUIDED ABOUT TWO PIVOT AXES

(75) Inventor: Erdinc Agirbas, Bayreuth (DE)

(73) Assignee: British American Tobacco (Germany) GmbH, Hamburg (DE)

( * ) Notice: Subject to any disclaimer, the term of this patent is extended or adjusted under 35 U.S.C. 154(b) by 0 days.

(21) Appl. No.: 13/820,118

(22) PCT Filed: Jul. 27, 2011

(86) PCT No.: PCT/EP2011/062943

§ 371 (c)(1), (2), (4) Date: Feb. 28, 2013

(87) PCT Pub. No.: WO2012/028394

PCT Pub. Date: Mar. 8, 2012

(65) Prior Publication Data

US 2013/0175189 A1 Jul. 11, 2013

(30) Foreign Application Priority Data

Aug. 31, 2010 (DE) ..... 10 2010 035 939

(51) Int. Cl.

| | |
|---|---|
| ***B65D 85/10*** | (2006.01) |
| ***B65D 5/66*** | (2006.01) |
| ***B65D 5/72*** | (2006.01) |
| ***A24F 15/12*** | (2006.01) |

(52) U.S. Cl.

CPC ..... *A24F 15/12* (2013.01); *B65D 85/1045* (2013.01); *B65D 5/6697* (2013.01)

USPC ..... 206/268; 206/273

(58) Field of Classification Search

USPC ..... 206/273, 268, 264, 265, 271; 229/87.13, 87.14, 229, 231, 145

See application file for complete search history.

(56) References Cited

U.S. PATENT DOCUMENTS

| | | | | |
|---|---|---|---|---|
| 4,170,327 | A * | 10/1979 | Bruml | 229/128 |
| 5,014,906 | A * | 5/1991 | Gero | 229/123 |
| 7,681,727 | B2 * | 3/2010 | Hunt et al. | 206/268 |
| 2008/0087712 | A1 * | 4/2008 | Hunt et al. | 229/87.13 |
| 2010/0320263 | A1 * | 12/2010 | Tawada et al. | 229/160.1 |

FOREIGN PATENT DOCUMENTS

| | | | |
|---|---|---|---|
| CA | 2716350 | A1 | 9/2009 |
| DE | 20020828 | U1 | 3/2001 |
| DE | 102008035473 | A1 | 2/2010 |
| FR | 2271988 | A2 | 12/1975 |
| WO | WO 2009127486 | A1 * | 10/2009 |

OTHER PUBLICATIONS

WO_2009127486.pdf.*

International Search Report and Written Opinion, mailed Sep. 14, 2011, for PCT/EP2011/062943, filed Jul. 27, 2011.

German Office Action mailed Jun. 7, 2011 for corresponding German Patent Application DE10 2010 035 939.4, filed Aug. 31, 2010. [with machine translation into English].

English Translation of the International Preliminary Report on Patentability, issued Mar. 5, 2013, for corresponding International Patent Application No. PCT/EP2011/062943, filed Jul. 27, 2011.

* cited by examiner

*Primary Examiner* — Mickey Yu
*Assistant Examiner* — Allan Stevens
(74) *Attorney, Agent, or Firm* — N. W. Poulsen; L. A. Pinol

(57) ABSTRACT

The invention relates to a packet for smoking products, in particular for cigarettes, the packet having a packet body accommodating smoking products and including a withdrawal opening, and also having a packet lid for sealing the withdrawal opening. The packet lid is guided by guiding elements such that it can be pivoted about two pivoting axes with respect to the packet body during opening and closing.

20 Claims, 6 Drawing Sheets

CIGARETTE PACK COMPRISING A COVER THAT IS GUIDED ABOUT TWO PIVOT AXES

CLAIM FOR PRIORITY

Figure 1:
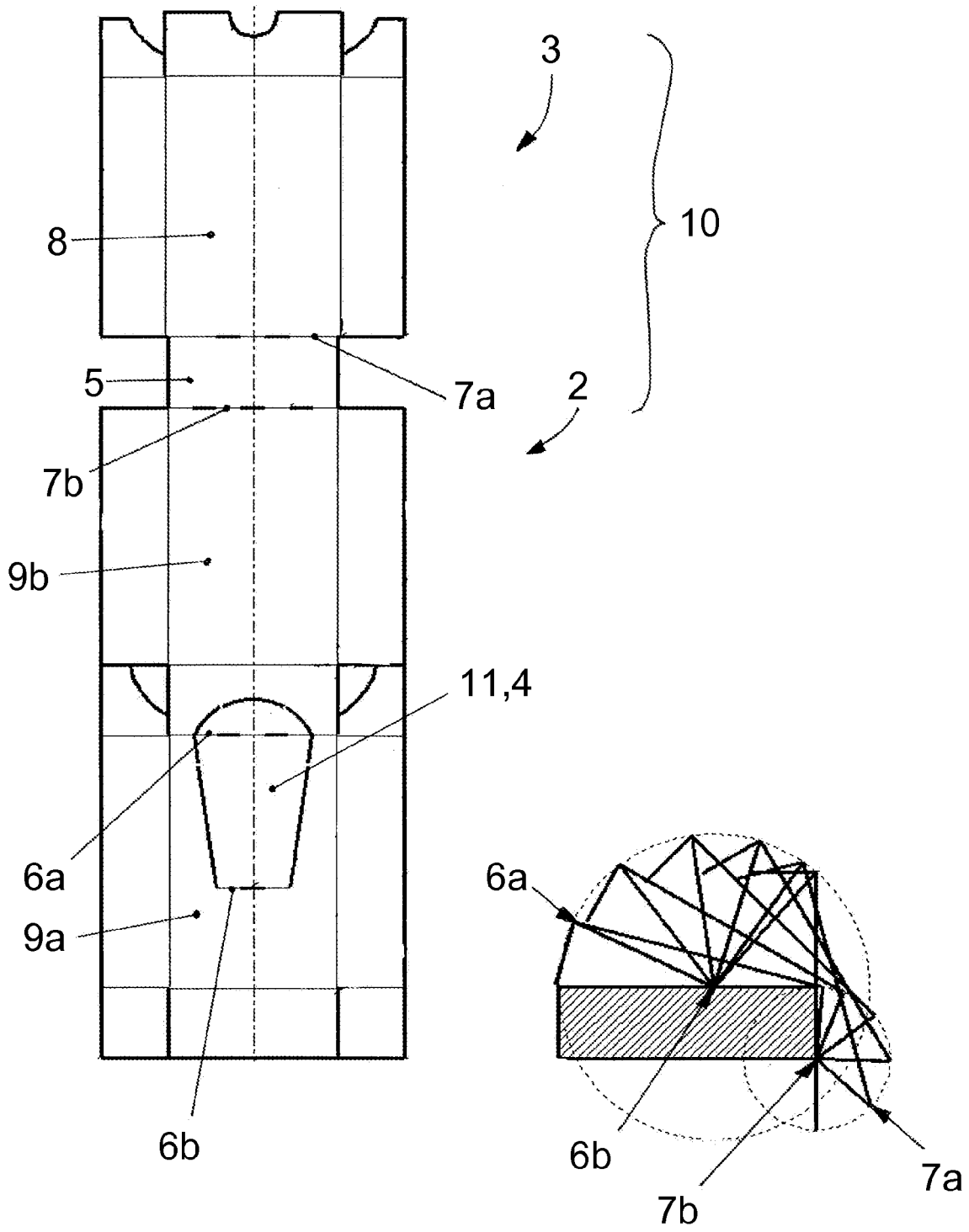
Figure 2A:
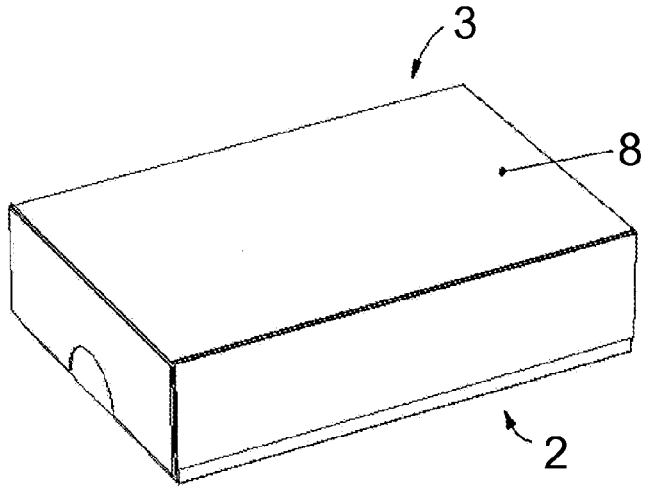
Figure 2B:
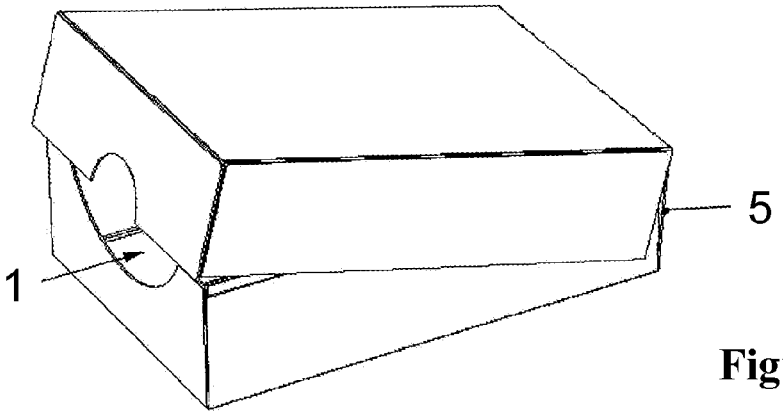
Figure 2C:
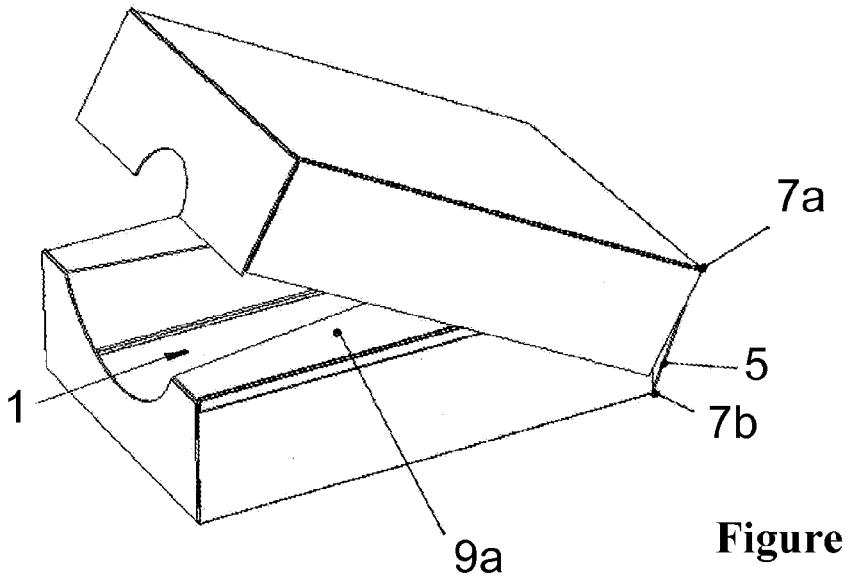

This application is a National Stage Entry entitled to and hereby claims priority under 35 U.S.C. §§365 and 371 to corresponding PCT application No. PCT/EP2011/062943, filed Jul. 27, 2011, which in turn claims priority to DE Application No. 10 2010 035 939.4, filed Aug. 31, 2010. The entire contents of the aforementioned applications are herein expressly incorporated by reference.

The invention relates to a cigarette packet comprising a packet body which accommodates the cigarettes, and a packet lid which seals a withdrawal opening on the packet body and is guided such that it can be pivoted about two pivoting axes with respect to the packet body, for opening and closing.

Cigarette packets typically exhibit the shape of a cuboid, wherein the withdrawal opening is usually formed on a short side area of the packet and can be sealed by means of a lid which is hinged on a main area of the packet, i.e. when the lid is opened and/or closed, it is pivoted about the joint axis.

The terms "main area" and "side area" of the packet, as used here, are to be understood as follows: if one imagines a typical cuboid-shaped cigarette packet, it comprises six side areas including three pairs of areas which in turn comprise two opposing areas of equal size. The areas which are largest in terms of their dimensions are referred to here as the main areas, while the side areas which adjoin the long edges of the main areas are to be referred to as the long side areas, and the side areas which adjoin the short edges of the main areas are to be referred to as the short side areas.

In the aforementioned cigarette packets of the prior art, the withdrawal opening thus lies on a short side area and is accordingly relatively small. If one wishes to enlarge the withdrawal opening in order to more conveniently withdraw the cigarettes, then the withdrawal opening necessarily has to extend over other areas of the cigarette packet, which in turn leads to a larger lid for sealing the withdrawal opening. If, as is typical, such a lid is pivoted about a joint for opening and closing, then the dimensions of the opened cigarette packet are substantially increased. This is often not desired, since the larger dimensions of the lid result in greater lever arms relative to the joint and therefore greater forces which act on the joint and can result in damage to the joint.

It is the object of the present invention to provide a cigarette packet in which the withdrawal opening can be configured to be large without substantially increasing the dimensions of the opened packet and without risking damage to the joint.

This object is solved by the subject of patent claim 1, wherein the sub-claims define preferred embodiments of the present invention.

Although the packet in accordance with the invention is described in the following in connection with cigarette packets, it is equally conceivable for it to be used as a packet for other smoking products, in addition to cigarettes.

The cigarette packet in accordance with the invention comprises a packet body which is configured to accommodate the smoking products and comprises a withdrawal opening, and a packet lid for sealing the withdrawal opening, wherein the packet lid is guided by means of guiding elements such that it can be pivoted about two pivoting axes with respect to the packet body, for opening and closing.

In other words, the packet lid is not pivoted about a single pivoting axis relative to the packet body, such that it thus performs a circular movement, as is typical in the prior art, but rather the packet lid is pivoted in accordance with the invention about two pivoting axes with respect to the packet body, such that it is moved along an elliptical trajectory during opening and/or closing. This movement is forced upon the lid by guiding elements, such that the lid performs a predefined movement relative to the packet body each time it is opened and closed.

In accordance with one preferred embodiment, said guiding elements are dimensionally stable and are hinged at one joint each on the packet lid and hinged at one joint each on the packet body. In other words, two joints—i.e. one on the packet lid and one on the packet body—are respectively connected by a dimensionally stable guiding element which can be pivoted with respect to the packet body and with respect to the packet lid via the respective joint. In particular when the joints arranged on the packet lid are configured as rotary joints, their joint axes coincide with the pivoting axes for the packet lid, such that the joints on the packet lid form the pivoting axes for the packet lid. Preferably, all the joints on the guiding elements are formed as rotary joints and/or hinges and accordingly have only one degree of freedom.

Although the joint axes of the different joints can be arranged in many different ways with respect to each other, it is particularly preferred if at least the joint axes of one guiding element run parallel to each other. A parallel arrangement of the pivoting axes with respect to each other is also particularly preferred, which in combination means that all the joint axes run parallel to each other. The respective joint axes are preferably also spatially fixed with respect to the packet lid and/or packet body.

In accordance with another preferred embodiment, the packet in accordance with the invention comprises a cuboid-shaped packet body and accordingly has a shape which is known from the prior art, wherein when it is closed, the packet lid can abut at least four exterior areas of the packet body, preferably one main area and three adjoining side areas, in particular two long side areas and one short side area or two short side areas and one long side area. Any other configurations are however equally conceivable, hence the packet lid could for example abut two main areas, a short side area and a long side area of the packet body. It is also conceivable for the packet lid to abut the entire extent or only a partial region of one or more areas of the packet body. However, it is particularly preferred if the areas of the packet lid abut the entire extent of the corresponding areas of the packet body. This also gives the closed packet an optically closed appearance, and no edges extend beyond the side areas of the packet.

In accordance with another preferred embodiment of the present invention, the two guiding elements exhibit different lengths, such that the joints on the first guiding element exhibit a greater distance from each other than the joints on the second guiding element. Such a configuration above all affects the movement performed relative to the packet body by the packet lid during opening and closing and is in particular necessary when the areas of the packet lid extend over broad regions of the areas on the packet body, as is also to be shown below.

Arranging the joints of a first guiding element on the edge of the main area of the packet lid and/or on a main area of the packet body and/or arranging the joints of the second guiding element on an edge of the main area of the packet lid and/or on an edge of a main area of the packet body is particularly preferred. The joint of the second guiding element which is arranged on an edge of a main area of the packet body can in particular be arranged on the main area of the packet body which lies opposite the main area on which the joint of the first guiding element is arranged on the packet body. When the packet lid is then opened, it is pivoted about pivoting axes which lie on opposing main areas of the packet body and is moved tightly around the packet body, so to speak. In this way, the dimensions of the opened packet as compared to the closed packet change to a substantially lesser extent than would be the case when opening a lid which can only be pivoted about one joint axis.

Providing the packet lid abuts at least one main area of the packet body, the withdrawal opening on this main area which is to be sealed by the lid can be configured to be substantially larger than would be possible in the prior art. Although it is conceivable for the withdrawal opening to extend over an entire area, for example a main area of the packet body, the withdrawal opening can also extend over only a partial region of an area of the packet body. In the latter case in particular, it would be conceivable for the withdrawal opening to additionally extend over other areas of the packet body. A withdrawal opening which is configured on a main area of the packet body can for example extend over one or two side areas which adjoin the main area, which makes it substantially easier to withdraw the cigarettes accommodated by the packet body.

The pivoting axis of the first guiding element is particularly preferably arranged on a main area of the packet body, specifically on the main area on which the withdrawal opening is also substantially configured, wherein "substantially" is intended to mean here that the "cut-out" for the withdrawal opening is larger on the main area than the "cut-out(s)" on the other area(s) of the packet body.

One major advantage of the present invention is that despite the more complex opening movement of the packet lid, the blank of the cigarette packet in accordance with the invention can be configured in one piece, such that other additional parts do not have to be added to the blank of the packet. As with conventional cigarette packets, the cigarette packet in accordance with the invention can also be manufactured from a planar material, preferably card, wherein the first guiding element can substantially consist of the material region of the blank which is cut out of the blank in order to form the withdrawal opening. It is also conceivable for the second guiding element to form a side area, i.e. a short side area or long side area, of the packet and to thus connect the short or long edges of the main areas of the packet lid and/or packet body which lie opposite each other when the packet is closed, and to accordingly be hinged at these edges.

In order to make it easier to withdraw cigarettes from the packet, pivoting the packet lid by 90° relative to the packet body is preferred, although smaller or larger opening angles are equally conceivable.

Preferred embodiments of the present invention are explained in more detail on the basis of the enclosed figures. The present invention can comprise any of the features shown here, individually and in any expedient combination.

Figure 3A:
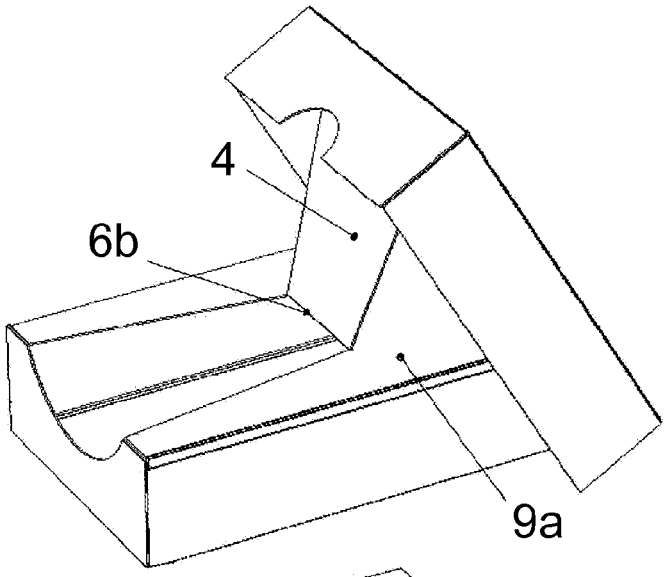
Figure 3B:
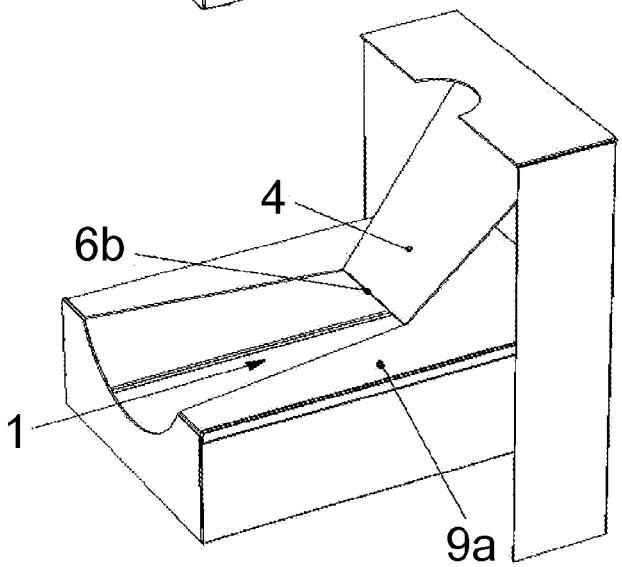
Figure 3C:
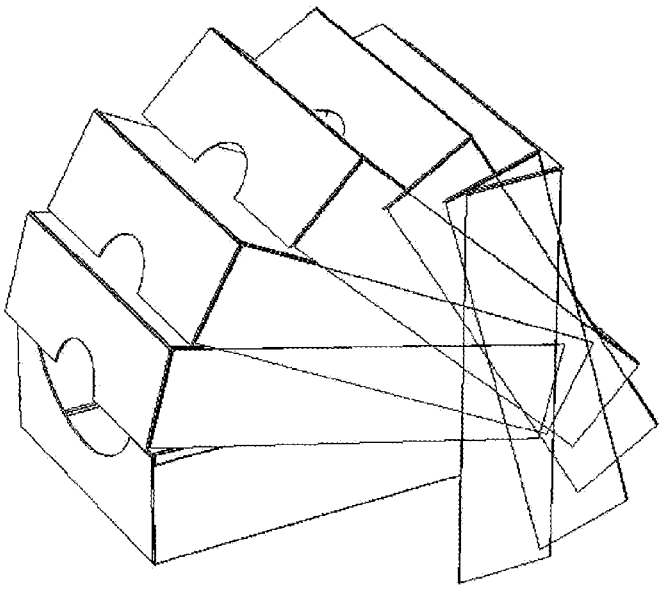
Figure 4:
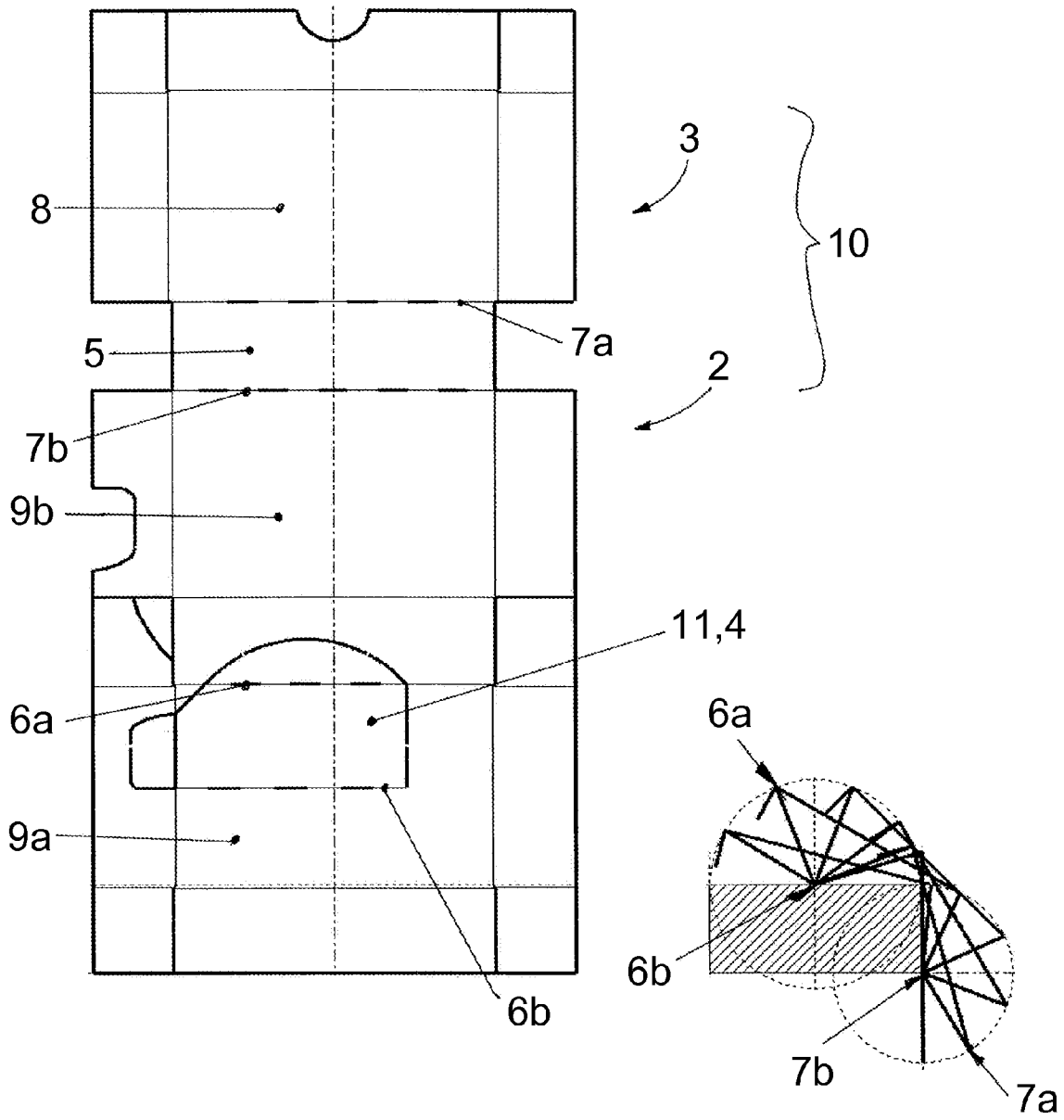
Figure 5A:
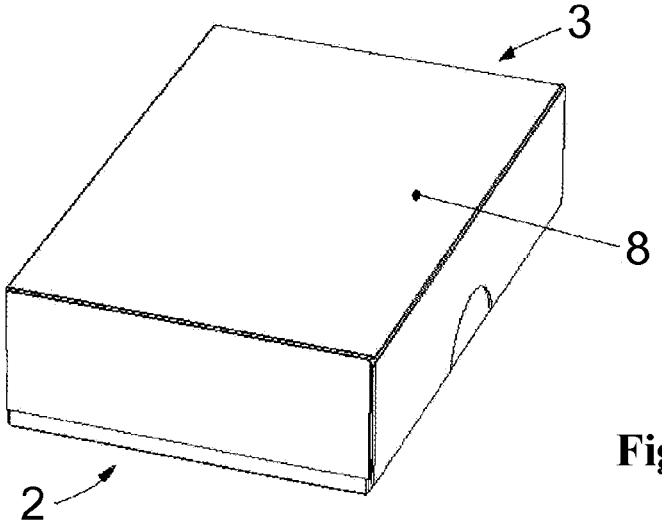
Figure 5B:
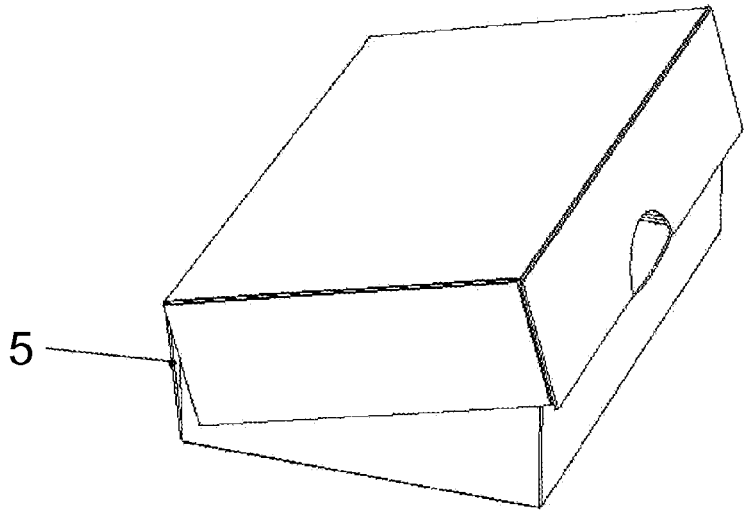
Figure 5C:
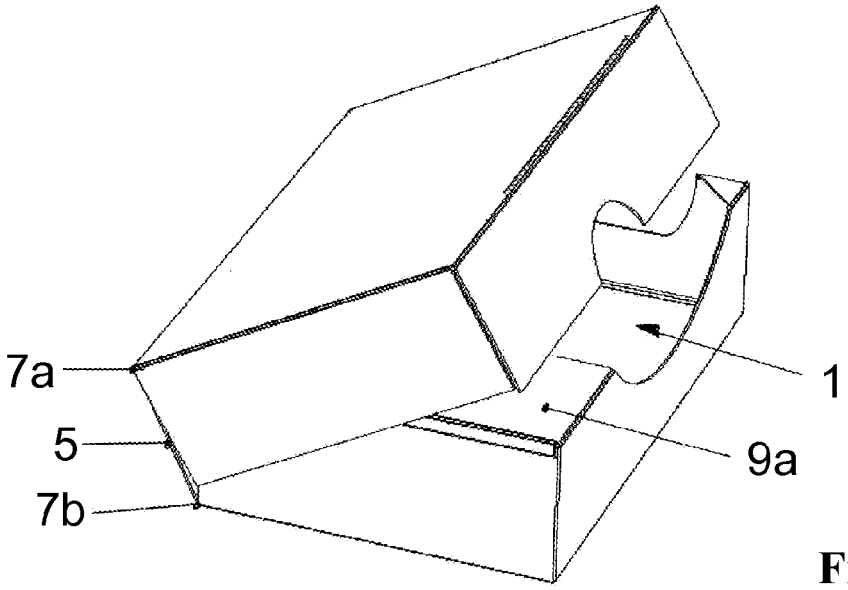
Figure 6A:
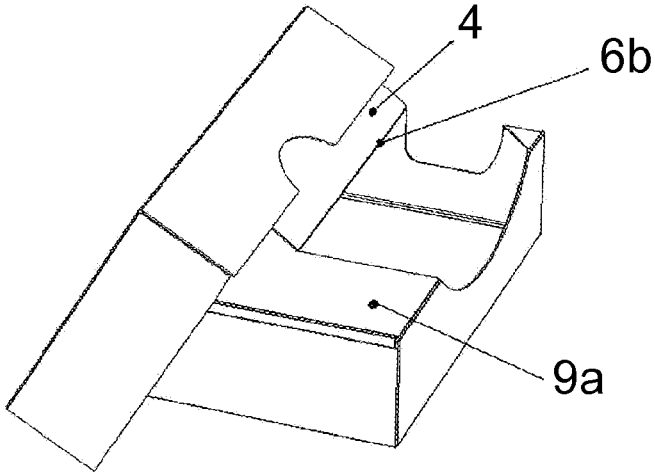
Figure 6B:
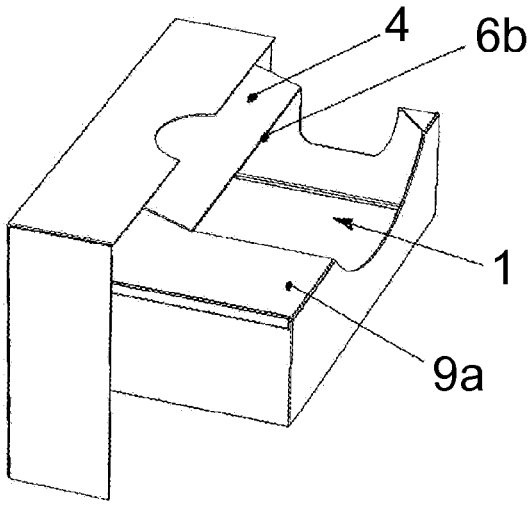
Figure 6C:
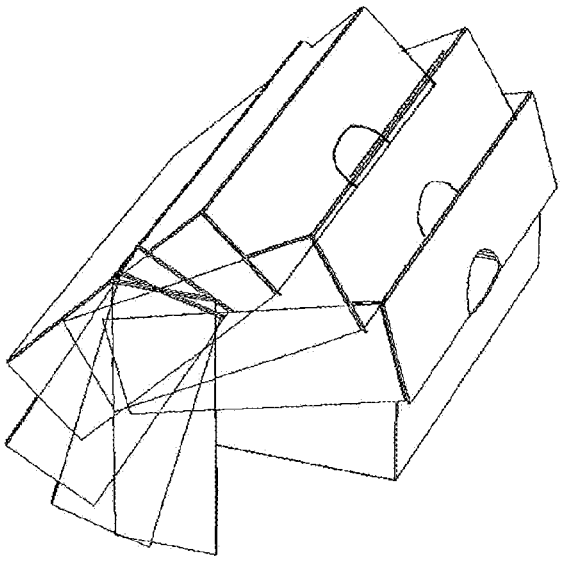

There is shown:

FIG. 1 a blank of a first embodiment of the present invention;

FIGS. 2*a* to 2*c*, 3*a* and 3*b* an isometric representation of the packet in accordance with a first embodiment, at different opening angles of the lid;

FIG. 3*c* a representation of the consecutive opening angles of the lid in the first embodiment;

FIG. 4 a blank of a second embodiment of the present invention;

FIGS. 5*a* to 5*c*, 6*a* and 6*b* an isometric representation of the packet in accordance with a second embodiment, at different opening angles of the lid;

FIG. 6*c* a representation of the consecutive opening angles of the lid in the second embodiment.

A blank of a first embodiment of the cigarette packet in accordance with the invention is shown on the left in FIG. 1. The upper part in the drawing subsequently forms the packet lid 3, while the lower part of the blank 10 in the drawing forms the packet body 2. What is initially noticeable is the near-trapeziform flap 11 in the region of the packet body 2, which will subsequently form the first guiding element 4. This region additionally marks the subsequent withdrawal opening 1 in the packet body 2. It can be seen that the trapeziform region extends on the main area 9*a* which subsequently faces the packet lid 3. In addition, a smaller region which is connected to the trapeziform region of the flap via a folding edge 6*a* is cut out on the (not otherwise indicated) short side area of the packet body 2, i.e. the withdrawal opening 1 will subsequently extend over both the main area 9*a* and the adjoining short side area. Said folding edge will subsequently form the pivoting axis 6*a* of the first guiding element 4 which is subsequently arranged on the packet lid 3, since the region which is cut out on the short side area is glued to a short side area of the packet lid 3 which lies on top of it when the packet is closed.

The first guiding element 4 is also connected to the packet body 2 in a joint via the pivoting axis 6*b* which is arranged on the main area 9*a*.

The main area of the packet body which lies opposite the main area 9*a* in the finished packet is formed by the area 9*b*, wherein the joint 7*b* of the second guiding element 5 which is subsequently arranged on the packet body 2 is formed on one of the short edges. In the finished packet, the area 5 lies opposite the short side area of the packet body 2 on which a part of the withdrawal opening 1 is formed.

The main area 8 of the lid 3 which subsequently comes to rest on the main area 9*a* is connected to the second guiding element 5 via the joint 7*a*.

A schematic lateral representation of the first embodiment of the cigarette packet in accordance with the invention is shown on the right next to the blank and includes the joints 6*a*, 6*b*, 7*a* and 7*b*, wherein the former are assigned to the first guiding element 4 and the latter are assigned to the second guiding element 5. The radii on which the joints 6*a* and 7*a* arranged on the lid 3 are moved when the lid 3 is opened and/or closed are also clearly shown. The joint 6*a* is accordingly moved on a larger radius than the joint 7*a*, which results from the fact that the first guiding element 4 is longer than the second guiding element 5. This results in an elliptical opening and/or closing movement of the lid 3 relative to the packet body 2.

It can also be seen that the joint 6*b* is situated on the main area 9*a* of the packet body 2 which points towards the lid 3, while the joint 7*b* is situated on the area 9*b* which lies opposite the area 9*a*, specifically at the edge to the short side area formed by the second guiding element 5.

FIGS. 2*a* to 2*c*, 3*a* and 3*b* show an opening process of the cigarette packet in accordance with a first embodiment of the present invention. The areas of the lid 3 abut the main area 9*a* and three of the adjoining side areas of the packet body 2, wherein the main area 8 of the lid 3 abuts on the main area 9*a* of the packet body 2. The second guiding element 5 abuts the top of the fourth, short side area of the packet body and extends over the entire fourth, short side area of the packet body. Equally, all the areas of the lid 3 also extend over the entire extent of the corresponding areas of the packet body 2. In order to make it easier to open the packet, a recess is provided on the front short side area of the lid, into which the user can grip and hold the packet body 2.

When the lid 3 is opened, the withdrawal opening—which extends over partial regions of the main area 9*a* and the adjoining short side area of the packet body 2—is revealed.

The second guiding element is hinged on the "rear side" of the packet at the short edges of the opposing main areas 8 and 9*b* of the lid 3 and packet body 2, respectively, which accordingly form the joints 7*a* and 7*b* for the second guiding element 5. The same applies to the first guiding element 4, which is connected to the packet body 2 via the joint 6*b*. The joint 6*a* lies on the short edge of the main area 8 of the lid 3, i.e. on the edge at which the main area 8 adjoins the short side area of the lid 3 comprising the recessed grip.

It is easily conceivable that when the packet is closed, the trapeziform and elliptical partial regions of the first guiding element 4 are inserted precisely into the recesses for the withdrawal opening 1 on said areas of the packet body 2, such that it is possible to completely close the packet body 2.

In FIG. 3*b*, a 90° maximum opening angle of the lid 3 has been reached. It is not possible to open the packet further, since the main area 8 of the lid 3 abuts the short side area on which the second guiding element previously lay.

FIG. 3*c* shows different degrees of opening for the packet, wherein it can in particular be seen that the long side areas of the packet lid 3 are guided in every position by the long side areas of the packet body 2 on which they abut when the packet is closed. This enables the lid 3 to be further stabilised during opening, in addition to being guided by the first guiding element 4 and second guiding element 5. It can also be seen that the front short side area of the lid 3 rises up from the packet body 2 during opening due to the configuration of the guiding elements 4 and 5 and the pivoting axes 6*a*, 6*b*, 7*a* and 7*b*, while the rear short side area of the lid 3 and/or the second guiding element 5 descend. This enables the lid 3 to be pivoted, even though all its side areas extend beyond the entire side areas of the packet body 2.

FIG. 4 shows a blank in accordance with a second embodiment of the present invention, wherein the elements which are functionally identical to the first embodiment from FIG. 1 shall not be described further.

It can be seen that the withdrawal opening extends over a number of areas of the packet body 2, i.e. a long side area and a short side area of the packet body, in order to make it easier to withdraw the cigarettes accommodated in the packet body 2. The essential difference with respect to the first embodiment is that the packet in accordance with the second embodiment is opened "transversely", i.e. the pivoting axes run parallel to the long edges of the main areas, for in the first embodiment, the pivoting axes run parallel to the short edges of the main areas.

FIGS. 5*a* to 6*c* do not show any particular differences with respect to the embodiment shown in FIGS. 2*a* to 3*c*. It can however be seen that the joint 6*b* extends as far as the short edge of the main area 9*a* of the packet body 2, resulting in a substantially larger withdrawal opening 1. In order to be able to withdraw the cigarettes via the short side area of the packet body, an additional recess which further enlarges the withdrawal opening 1 is formed on the short side area of the packet body.

The invention claimed is:

1. A packet for smoking products formed from a single-piece blank, comprising a packet body which is configured to accommodate the smoking products and comprises a withdrawal opening, the packet body including a first main body portion, a second main body portion, and opposing short and long side portions; and a packet lid configured to seal the withdrawal opening, including a main lid portion and opposing long and short lid side portions, the packet lid configured to be guided by guide elements such that the packet lid can be pivoted about two pivoting axes relative to the packet body during opening and closing, one of the lid side portions delineated on two sides by joint-defining fold lines, and at least one of the body portions including a partial-cutout flap hingedly connected to the corresponding body portion along a further fold line, thereby forming one of the guide elements, the flap including a pivoting axis and being formed from a material region that is cut from the packet body to form the withdrawal opening.

2. The packet according to claim 1, wherein the guide elements are dimensionally stable and are hinged at one joint each on the packet lid and hinged at one joint each on the packet body, and wherein at least the joints on the packet lid form the pivoting axes.

3. The packet according to claim 2, wherein the pivoting axes of the joints of at least one guide element run parallel to each other.

4. The packet according to claim 1, wherein the packet body is cuboid-shaped, and wherein when the packet is closed, the packet lid abuts at least four exterior areas of the packet body.

5. The packet according to claim 2, wherein the guide elements exhibit different lengths, such that the joints on a first guide element exhibit a greater distance from each other than the joints on a second guide element.

6. The packet according to claim 2, wherein one of the joints of one of the guide elements is arranged on at least one of an edge of the main lid portion, the first main body portion and the second main body portion.

7. The packet according to claim 1, wherein the withdrawal opening extends over at least two areas of the packet body.

8. The packet according to claim 2, wherein the withdrawal opening is formed substantially on a main area of the packet, in particular on the main area on which the joint of a first guide element is also arranged.

9. The packet according to claim 1, produced from a single-piece blank of a planar material, wherein the guide elements are part of the blank, and wherein at least one of the guide elements is formed from one of:

the material region which is cut from the packet body and a side area of the packet.

10. The packet according to claim 1, wherein the packet lid can be pivoted by 90° relative to the packet body.

11. The packet according to claim 3, wherein the pivoting axes run parallel to each other.

12. The packet according to claim 4, wherein the packet lid abuts the at least four exterior areas of the packet body over their entire extent.

13. The packet according to claim 1, wherein the guide elements are dimensionally stable and are hinged at one joint each on the packet lid and hinged at one joint each on the packet body, and wherein at least the joints on the packet body form the pivoting axes.

14. The packet according to claim 1, wherein the packet lid includes a grip-enabling recess.

15. A packet for smoking products formed from a single-piece blank, comprising:

a packet body having two main body panels and a plurality of side body panels, wherein at least one of the two main body panels includes a partial-cutout flap, said flap arranged to hingedly connect with the corresponding body portion along a fold line, and said flap including a pivoting axis and serving as a guide, wherein the partial-cutout flap is formed from a material region that is cut from the packet body to form a withdrawal opening;

a packet lid having a main panel and a plurality of side panels, and at least one further guide, wherein the withdrawal opening is provided in the packet body in at least one of:

one of the two main body panels; and one of the plurality of side body panels, and wherein the guides enable the packet lid to pivot about at least two axes during actuation.

16. The packet according to claim 15, wherein the lid is configured to follow an elliptical trajectory during actuation.

17. The packet according to claim 15, wherein at least one of the guides is pivoted with respect to the packet body via a rotary joint.

18. A single-piece blank for manufacturing a packet comprising:

a first main body portion, a second main body portion, a main lid portion, opposing short and long body side portions, and opposing short and long lid side portions, wherein at least one of the body portions includes a partial-cutout flap, said flap arranged to hingedly connect with the corresponding body portion along a fold line, and said flap including a pivoting axis, wherein the partial-cutout flap is formed from a material region that is cut from one of the main body portions to form a withdrawal opening, and wherein one of said lid side portions is delineated on two sides by joint-defining fold lines.

19. The blank according to claim 18, further comprising a plurality of grip-enabling recesses formed in a plurality of the lid side portions, arranged and dimensioned such that the plurality of grip-enabling recesses collectively form a single recess upon folding of the blank.

20. The packet according to claim 2, wherein one of the joints of one of the guide elements is arranged on at least one of an edge of a main area of the packet lid and an edge of a main area of the packet body.

* * * * *

UNITED STATES PATENT AND TRADEMARK OFFICE

CERTIFICATE OF CORRECTION

PATENT NO. : 8,973,750 B2
APPLICATION NO. : 13/820118
DATED : March 10, 2015
INVENTOR(S) : Erdinc Agirbas It is certified that error appears in the above-identified patent and that said Letters Patent is hereby corrected as shown below:

On the title page, under Foreign Application Priority Data, "10 2010 035 939" should read --10 2010 035 939.4--

Signed and Sealed this
Eighteenth Day of August, 2015

Michelle K. Lee

Michelle K. Lee
*Director of the United States Patent and Trademark Office*